US007981451B2

(12) United States Patent
Ozanne

(10) Patent No.: US 7,981,451 B2
(45) Date of Patent: Jul. 19, 2011

(54) CAPSULE FOR THE PREPARATION OF A BEVERAGE

(75) Inventor: Matthieu Ozanne, Chessel (CH)

(73) Assignee: Nestec S.A., Vevey (CH)

( * ) Notice: Subject to any disclaimer, the term of this patent is extended or adjusted under 35 U.S.C. 154(b) by 554 days.

(21) Appl. No.: 12/089,559

(22) PCT Filed: Oct. 2, 2006

(86) PCT No.: PCT/EP2006/066945

§ 371 (c)(1),
(2), (4) Date: Nov. 11, 2008

(87) PCT Pub. No.: WO2007/042414

PCT Pub. Date: Apr. 19, 2007

(65) Prior Publication Data

US 2009/0220650 A1 Sep. 3, 2009

(30) Foreign Application Priority Data

Oct. 14, 2005 (EP) ..... 05109566

(51) Int. Cl.
*B65B 29/02* (2006.01)

(52) U.S. Cl. ..... 426/79; 99/295

(58) Field of Classification Search ..... 426/79, 426/78; 99/295
See application file for complete search history.

(56) References Cited

U.S. PATENT DOCUMENTS

| | | | | |
|---|---|---|---|---|
| 2002/0148356 | A1 | 10/2002 | Lazaris et al. | |
| 2002/0148357 | A1 | 10/2002 | Lazaris et al. | |
| 2003/0005826 | A1* | 1/2003 | Sargent et al. | 99/279 |
| 2005/0115415 | A1* | 6/2005 | Arrick et al. | 99/348 |

FOREIGN PATENT DOCUMENTS

| | | |
|---|---|---|
| DE | 26 45 885 | 7/1977 |
| EP | 0 468 079 | 1/1992 |
| EP | 0 512 468 | 11/1992 |
| EP | 0 512 470 | 11/1992 |
| EP | 0 615 921 | 9/1994 |
| EP | 1 101 430 | 5/2001 |
| EP | 1 440 904 | 9/2008 |
| FR | 2 617 389 | 1/1989 |
| GB | 1 397 116 | 6/1975 |

OTHER PUBLICATIONS

Written Opinion of the International Searching Authority (5 pgs.).

* cited by examiner

*Primary Examiner* — Rena L Dye
*Assistant Examiner* — Chaim Smith
(74) *Attorney, Agent, or Firm* — K&L Gates LLP

(57) ABSTRACT

Capsule for the preparation of a beverage in a beverage machine comprising an enclosure (20) containing one or more beverage ingredients, a filtering wall (22) delimiting at least one filtering side of the enclosure, wherein the capsule further comprises an overflow wall (3B) that is positioned in the path of the brewed liquid after the filtering wall and which comprises at least one overflow aperture or is associated with at least one puncture means (8A, 8B) or, respectively, puncture indication means capable of producing or, respectively, indicating at least one overflow aperture. The capsule of the invention is designed for delivering a brewed liquid at relatively low pressure and is more particularly suited for tea beverages.

30 Claims, 15 Drawing Sheets

CAPSULE FOR THE PREPARATION OF A BEVERAGE

The present invention relates to a capsule for preparing and delivering a beverage in a brewing device. The present invention more particularly aims at providing a capsule adapted to deliver brewed tea although other beverages can be successfully brewed in the capsule.

Different beverage capsules for brewing beverages in a suitable beverage machine are known. However, there is no existing capsule that can deliver a high quality tea beverage from a capsule containing leaf tea product and the like.

Quality of a tea beverage is highly dependent on the quality of the leaf tea ingredients, i.e., the tea origin used (soil, drying, blending, etc.) and their storage conditions. For instance, tea ingredients are usually sensitive to oxygen and light. Preferred tea ingredients are taken from loose leaves, chiselled or broken in small fragments. However, brewing conditions are also important to take full advantage of the quality of the ingredients used.

Another problem with tea beverages resides in that taste cross-contamination must be preferably avoided. Taste cross-contamination happens when two capsules are sequentially brewed in the machine and when a taste residue is left by the first capsule on permanent parts of the machine that can consequently affect the taste of the second capsule which is brewed just after the first capsule. For tea, this can be an issue with certain tea varieties that deliver a high aroma profile such as mint tea or other highly flavoured varieties. Also tea residue may constitute a soil for bacterial growth and may lead to hygiene issues which need to be tackled.

One commercially successful capsule system for extracting coffee beverage from capsules consists in placing an air- and water-impermeable capsule into an extraction device, injecting hot water into the capsule until the internal pressure in the capsule reaches the value at which a closing membrane is tom or pierced so that liquid extract can be released out of the capsule. A capsule adapted for such a process of extraction is described in EP 0 512 468. The process itself is described in EP 0 512 470. This method provides a high quality espresso-type coffee. The ground coffee is filled in the capsule fresh and can be stored many months without significant loss of aroma. The release of the coffee is slightly delayed due to a retarded opening of the membrane under pressure from the time water starts to be injected in the capsule. As a result, coffee can be fully extracted under optimal pressure and heat conditions. A stable and thick crema or foam is also produced due to high stress, pressure release and gas-entrapment conditions which are specific to this method.

However, such capsule and process are not optimal for carrying out the infusion or brewing of beverages such as tea or herbal tea. The result obtained is poor in term of taste, the beverage has a too high turbidity and may also comprise an undesired foam layer. Therefore, surprisingly a premium quality of tea beverage cannot be reached by such method.

Other capsule systems using pressure for brewing product can only deliver tea beverages that are too turbid, of poor product concentration and/or of taste that is not of sufficient quality for tea experts.

Capsules containing roast and ground coffee in which hot water flows under gravimetric force through the capsule are known. A capsule of this general type is described in British Patent No. 1397116. In this method, water is injected from the top of the cartridge and flows down through the ground coffee, through a filter and finally through a piercing hole or holes of the bottom side. More sophisticated systems are based on a similar approach using trunco-conical cartridges such as in US 2002/0148356 or using rectangular cartridges such as in US 2002/0148357.

EP 0 615 921 relates to a rigid cartridge for coffee, leaf tea or chocolate. The beverage package is used with water flowing in an upward direction. The sidewall of the package is formed from a water-impermeable material in order to encourage an even flow of water through the beverage package. One issue is that freshness of the ingredients cannot be maintained long enough unless an additional airtight package is utilized to over wrap the cartridge. Another problem with such solution lies in that beverage cannot be properly conducted to the recipient (cup, mug, glass, . . . ) after being released from the package.

EP 1 101 430 relates to a beverage filter cartridge system in which pressurized water (about 1.4 to 1.7 bar) is provided in downward direction through the upper side of the cartridge and beverage is collected from a lower side of the cartridge. This document also contemplates the solution in which the pressurized hot water is introduced through the bottom side and upwards into the beverage product. However, in this solution, the inlet traverses the filter and the product cake from bottom and water flows finally downward both through the fluid medium ingredients up to a bottom outlet. According to the patent application, the introduction of pressurized hot water squeezes the beverage powder into a cake and permeates the powder more efficiently.

EP 1 440 904 A1 relates to a cartridge with a bottom lid that is pierceable in use when the cartridge is in an horizontal orientation to accommodate both inflow and outflow of an aqueous medium to form the beverage from interaction of the medium and the one or more beverage ingredients in the chamber. According to this document, the horizontal positioning of the cartridge during use allows for an optimised flow of the aqueous medium through the cartridge whereas, with vertically oriented cartridges, the water flows too quickly under the influence of gravity and may thus by-pass portions of the beverage ingredients. Therefore, this document claims that a horizontally oriented cartridge allows avoiding this problem, in particular, by arranging for an upward element of flow between the inlet and outlet positions.

However, one has surprisingly found that the darker brewed beverage portion tends to stay in the bottom of the cartridge because of its density that is higher than the rest of the beverage. Therefore, a beverage concentration gradient tends to form within the capsule with the denser beverage portion remaining in the bottom of the capsule; such portion being finally not delivered into the cup. As a result, the resulting tea beverage in the cup may be of insufficient quality despite the use of good quality ingredients. There is a need to overcome this problem.

Therefore, the present invention aims at proposing a design of capsule that promotes optimal conditions for the preparation of a tea beverage and the like.

BRIEF SUMMARY OF THE INVENTION

In the present application, the terms "capsule" or "cartridge" or "package" are considered as synonymous. The term "capsule" will be preferentially used. The words "brewing" or "infusion" are used as synonymous. The term "brewing fluid" generally refers to the liquid that serves to infuse the beverage ingredients, more generally, hot water.

In the present application, the term "tea" encompasses all type of leaf tea such as green tea, black tea, white tea, chai tea, flavoured tea and herbal or fruit tea. The term "leaf tea" or "leaf ingredient" refers to brewable tea or other ingredients in whatever form such as complete, cut or chiselled leaves, small fragments of leaves, powder or dust.

The present invention provides a capsule that is adapted to brew or infuse beverages in a beverage machine that may provide the following advantages:

- the quality of the beverage can be improved, in particular, in relation to the beverage concentration into the cup, the taste and the reduced turbidity,
- the capsule is less complicated and less expensive to produce,
- the beverage delivery is cleaner and it reduces or eliminates the taste cross-contamination and hygiene issues,
- the convenience of the capsule handling, i.e., insertion and collection of the used capsules can be improved.

For these purposes as well as many others possible, the invention relates to a capsule for the preparation of a beverage in a beverage machine comprising:

an enclosure containing one or more beverage ingredients;

a filtering wall delimiting at least one filtering side of the enclosure, wherein it comprises an overflow wall that is positioned in the path of the brewed liquid after the filtering wall and which comprises at least one overflow aperture or is associated with at least one puncture means or, respectively, puncture indication means capable of producing or, respectively, indicating at least one overflow aperture.

Furthermore, the filtering wall preferably extends from below a median horizontal plane passing through the enclosure when the capsule is oriented so that at least one overflow aperture or puncture means or, respectively the puncture indicating means, is placed above said plane.

Therefore, according to one aspect of the invention, but without willing to be bound to any theoretical model, the capsule is designed to behave like a "siphon" to enable the denser liquid to leave the capsule and to become dispensed, while at the same time, the beverage ingredients can be submerged by the brewing fluid therefore avoiding bypassing areas in the enclosure and ensuring that the mass of ingredients fully interacts with the brewing fluid.

As a result, the capsule of the invention proposes a design that combines both the advantages of the gravimetric top-down directional brewing where the denser liquid can be captured and the advantages of the upward directional brewing where the full mass of product can be fully and slowly submerged but does not retain the disadvantages of each of said brewing principles.

In one mode, the filtering wall of the capsule extends substantially along a whole transversal section of the enclosure, e.g., from the bottom of the enclosure to the top of the enclosure when the capsule is placed in the brewing conditions. This filtering wall creates thus a sufficiently large filtering surface for the brewed liquid that favours a lower brewing pressure in the enclosure and a slow flow while the flow rate can stay within the acceptable range.

In one preferred aspect, the overflow wall of the capsule is placed separately in front or adjacent of the filtering means. In one mode the overflow wall is separate from the filtering wall with an interstitial space there between. In another possible mode, the overflow wall and the filtering means are adjacent while forming an interstitial space. The overflow wall and filtering can be made of an integral piece. These configurations seem to promote the "siphon" effect with the denser liquid portion in the bottom of the enclosure being able to traverse the filtering wall and moves upwardly in the interstitial space. The denser liquid is thus no longer permanently confined in the bottom of the enclosure but can be drawn out through the interstitial space so formed. The dimensions of the interstitial space can range of from 0.1 to 8 mm, preferably, about 0.5 to 3 mm.

In one aspect, the at least one overflow aperture, or puncture means or puncture indicating means is situated above the ¾ of the height of the enclosure; even preferably, the aperture is substantially horizontally aligned with the top end of the enclosure. As a result the whole mass of the beverage ingredients can be properly submerged and consequently properly brewed regardless of the filling level of the enclosure by the beverage ingredients.

In another aspect, the filtering wall and the overflow wall are substantially parallel to each other. Such a configuration seems to promote the effect of the dense liquid to be moved upwardly but also the filter wall can filter the brewed liquid at all levels of the enclosure so that liquid can transfer at a sufficient flow rate through the filter without the pressure rising too much in the enclosure.

In one embodiment of the invention, the overflow wall is a puncturable membrane. The membrane can so be opened just before brewing to prevent pressure to rise in the enclosure that would negatively affect the quality of the brewed beverage. A low pressure proves to improve quality of the beverage, in particular, to reduce its turbidity.

In another possible embodiment, the overflow wall comprises at least a premade overflow aperture. The overflow can be premade by construction per se of the capsule. The overflow wall can be internal to the capsule and protected by an outer closing membrane. The closing membrane can close the capsule in a gastight manner to improve the maintenance of freshness of the ingredients contained in the enclosure. The membrane can be punctured by a puncture means that is either part of the capsule or foreign to the capsule (i.e., part of the machine receiving the capsule). The membrane can be punctured for forming an outlet for the delivery of the brewed beverage out of the capsule. Preferably, the membrane is punctured wherein no significant positive pressure has been built in the enclosure.

In one construction, the capsule comprises a shell and an overflow membrane that closes the shell in a gas tight manner.

According to the invention, the filtering wall is preferably a pre-fabricated filter media which has the function to remove undesirable insoluble particles from the brewed liquid. The filter media can be constructed from a variety of materials including, but not limited to, plastic, foil, non-woven polyester, polypropylene, polyethylene, paper materials, and combinations thereof. The filter media comprises one or more filtering orifices that allow the free passage of the infused solution, while simultaneously preventing the passage of a significant amount of undesirable insoluble ingredient particles. In particular, for a tea beverage, the filter media is important to maintain the majority of tea solid particles coming from the leaf powder or finely cut, chiseled or crushed particles, inside the enclosure. The filter should preferably be sufficiently rigid to not deform too much under the pressure of water in the enclosure which would otherwise close the interstitial space and block the beverage upward flow. Therefore, for a paper filter, the G.S.M (grammes per square meter) of the filter should be preferably above 10 $g/m^2$, even more preferably above 15 $g/m^2$. Also, the pressure in the enclosure should remain low and therefore the fluid permeability of the filter should so be sufficient to let beverage traverse slowly the filter without offering too much resistance. For this, its permeability can be defined by an air permeability of the filter that should preferably be higher than 1200 $l/m^2$, more preferably higher than 1650 $l/m^2$. The filter means can also be formed of a multitude of small needles protruding from the overflow wall.

In a mode, the capsule comprises a cover that is attached to the shell and faces the overflow membrane. A cover can be a rigid or semi-rigid part. The at least one puncture means or puncture indicating means can be supported by the cover. The cover being so relatively close to the puncturable seal membrane, it assists in opening the membrane to create the overflow wall necessary for brewing the beverage. The cover may be distant from the membrane of a distance between 0.5 to 10 mm, preferably 2 to 8 mm.

The advantage of having the puncture means or puncture indication means as a part of the capsule itself (or cover), is essentially that less physical interaction is produced between the beverage and the machine part which results in less cross-contamination issue and less cleaning. The mechanical perforator can be activated using an activating system of the machine (e.g., a solenoid driven pusher) or manually by the user without mechanical/hydraulic intervention of the machine.

The puncture means can be activated to form at least one aperture in the overflow wall or in a cover membrane for creating a delivery outlet in case the overflow wall has premade overflow aperture(s).

The cover may also be given the function to conduct the brewed liquid smoothly to a beverage outlet that is distinct from the overflow aperture. For this, it can comprise a beverage flow guiding means configured to guide the beverage flow to a beverage outlet of the capsule.

According to another functional aspect of the cover, the cover can comprise a beverage flow guiding means configured to guide the beverage flow to a beverage outlet of the capsule.

Therefore, the brewed liquid can be dispensed properly and hygienically into the recipient (cup, mug, . . . ) while keeping a simple capsule construction and promoting an easy handling of the capsule in the machine.

Furthermore, in one mode, the beverage outlet is placed at a region of the cover that is substantially opposite to the puncture means or puncture indicating means thus promoting a more "direct flow" approach with less chance of the brewed liquid to contaminate parts of the brewing device while ensuring, at the same time, that the liquid overflow is properly carried out in the capsule during brewing so that the ingredients are properly infused and product concentration in the cup is properly controlled.

In another aspect of the invention, the capsule comprises at least two puncture means or puncture indicating means placed at substantially opposite regions of the cover relative to a centreline of the cover and two outlet means placed at each end of the guiding means. This configuration provides the advantage that the capsule can be oriented in more than one position when it is inserted in the brewing device while the overflow wall still remaining operable, consequently, providing a better convenience for the user.

In one possible mode, the puncture indicating means can consist of at least one guiding hole through the cover for the introduction of a perforator that is foreign to the capsule. The perforator is therefore a part of the machine. The perforator can be mechanical and/or hydraulic. A mechanical perforator can be one or more needles or blades. An hydraulic perforator can be one or more fluid jets of sufficient velocity to punctually perforate the overflow wall. This mode enables to reduce complexity and production costs of the capsule.

In another option, the puncture means is supported by the capsule, i.e., the cover, and consists of at least one flexural blade that comprises a perforator. The puncture means can so be activated by a pusher of the brewing device or manually before brewing or at the start of the brewing process in order to create the overflow aperture in the sealing wall.

The capsule can be conceived with a certain asymmetry in order to facilitate a proper insertion in the brewing device by the user. For this, the capsule can have an elongated shape with an axial distance and a shorter transversal distance and the at least one puncture means or puncture indicating means can be aligned along the axial distance. As a result, the user is forced to insert the capsule in a predetermined orientation that is desirable for a correct operation of the capsule as aforementioned. In a mode, the capsule can be ovoïdal or rectangular.

BRIEF DESCRIPTION OF THE DRAWINGS

Embodiments of the present invention will now be described, by way of example only, with reference to the accompanying drawings, in which.

DETAILED DESCRIPTION OF THE INVENTION

Figure 1:
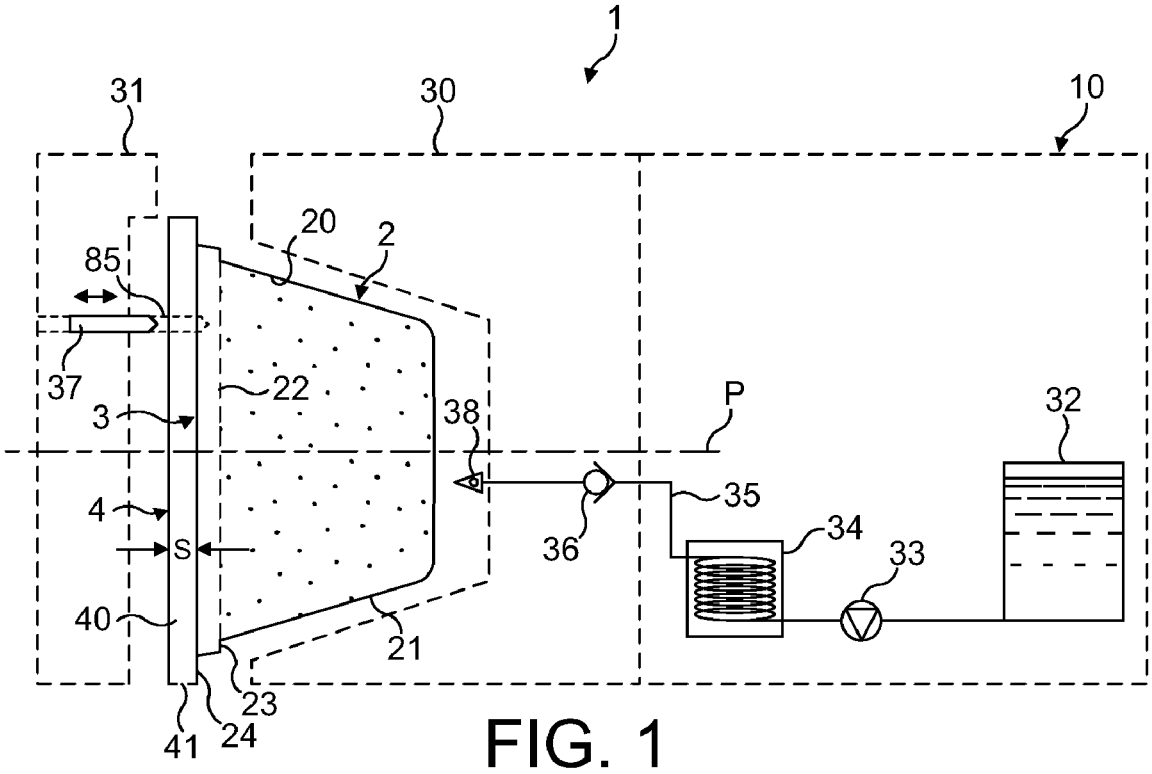
FIG. 1 is a schematic illustration of a capsule brewing system before brewing according to a first embodiment.

First of all, the general brewing principle of the invention will be explained in relation to FIGS. 1 and 2 and a first possible embodiment of the capsule of the invention.

A capsule system 1 is provided that comprises a capsule 2 and a beverage brewing device 10. For simplicity, the beverage brewing device is only schematically depicted and may, in reality, comprise additional technical features within the normal knowledge of the person skilled in the art. The capsule comprises an enclosure 20 containing beverage ingredients such as leaf tea and the like. The enclosure is demarcated by a cup-shaped housing 21 and a filtering wall 22 that is fixedly attached to peripheral inner step 23 of the housing 21. The enclosure is preferably impermeable to gas and light. The housing may encompass different cross sections such as a circular, ellipsoid, square, rectangular or polygonal section that determine as a matter of fact the general profile of the filtering wall 22. The enclosure is sized to accommodate a dose of leaf beverage ingredient of typically about between 1 to 10 grams, preferably 2 to 5 grams. The dose of leaf ingredient may depend on the final volume of beverage to produce. For an individual cup of tea, a typical dose can be of about 2 grams whereas for a tea pot, a typical dose can be of about 8 to 10 grams. As clearly apparent in FIG. 1, the capsule is positioned relative to the brewing device so that the filtering wall 22 extends substantially vertical and from substantially the bottom of the enclosure. For this, the capsule is preferably positioned in a "vertical" arrangement in the brewing device 1. The cup-shaped housing 21 can be so oriented with its large opening and its bottom oriented in a vertical position.

The capsule is preferably closed by a sealing wall 3 that hermetically closes the enclosure 20. The sealing wall is attached, for instance, to a peripheral outer rim 24 of the cup-shaped housing.

Both the sealing wall and the housing can be made of oxygen barrier materials and the enclosure can be substantially free of oxygen so that the freshness of the beverage ingredients can be preserved during an extended period of time. The sealing wall can be a flexible membrane or a semi-rigid plastic part. A puncturable sealing membrane is preferred such as a monolayer or a multi-layer membrane, typically, laminates of PET/Aluminium/PP, PE/EVOH/PP, PET/Metallised/PP, Aluminum/PP.

The enclosure is preferably oxygen free and may contain flushed inert gas such as N2, N2O or CO2.

The capsule can further comprise a cover 4 that is also attached to the rim 24 of the housing and overlaps the sealing wall 3. The cover forms an internal channel 40 that terminates at its side end by an outlet 41. The cover is provided with a puncture indicating means 85 in the form of a predefined hole or a weakened or breakable zone.

The shape of the housing of the capsule is not very critical. Preference is given to a trunconical, ellipsoidal or hemispherical shapes for different reasons. This allows a larger surface for the exit of the beverage through the sealing wall when perforated and a reduction of the inside pressure. The housing can also be manufactured industrially at lower cost by plastic thermoforming or aluminium deep drawing. This shape with smoother corners also favours the removal of the handling members and so ejection of the capsule.

Turning to the brewing device 10, it comprises capsule handling members 30, 31 that are configured to hold the capsule in the "vertical" arrangement as defined. These handling members 30, 31 can be machine jaws or any suitable mechanical enclosing means that can open and close about the capsule and can maintain it firmly in place. There is no need for providing high closing forces since the involved fluid pressure in the capsule remains relatively low and, preferably, as close as possible to the atmospheric pressure. Also, since the capsule can withstand the low brewing pressure therefore the capsule does not necessarily need to be entirely enclosed but simply held water tightly in place during brewing. This participates to a simplification of the machine and it reduces machine costs.

The brewing device comprises a water supply 32, such as a water tank, a water pump 33, a heater 34 and a hot water injection line 35 that is managed through the handling member 30. The brewing device may also comprise a controller and a user interface board (not shown) to manage the beverage preparation cycles as known in the art. A backpressure valve 36 can be provided to lower the pressure at the entry side or injection member 38 (such as a needle(s) or blade(s) and a water inlet) in the capsule. Of course, the backpressure valve could be omitted and a low pressure pump could be used that delivers fluid at low pressure. Medium to high pressure pump may however be preferred because of their robustness and reliability and so used in combination with a backpressure valve.

The brewing device may further comprise a means 37 for perforating the sealing wall at an overflow location of the enclosure. As shown in FIG. 1, the perforating means 37 can be activated after closing of the handling members 30, 31 about the capsule. The perforating means is forced or guided through the cover 4 through a puncture indicating means 85 such as a hole having a diameter slightly larger than the perforator. The perforator can engage the sealing wall 3 in puncturing to create an overflow aperture and then is retracted away from the aperture to leave the aperture fully open. The perforator can be driven by a solenoid or any other equivalent drive means or even manually.

Figure 2:
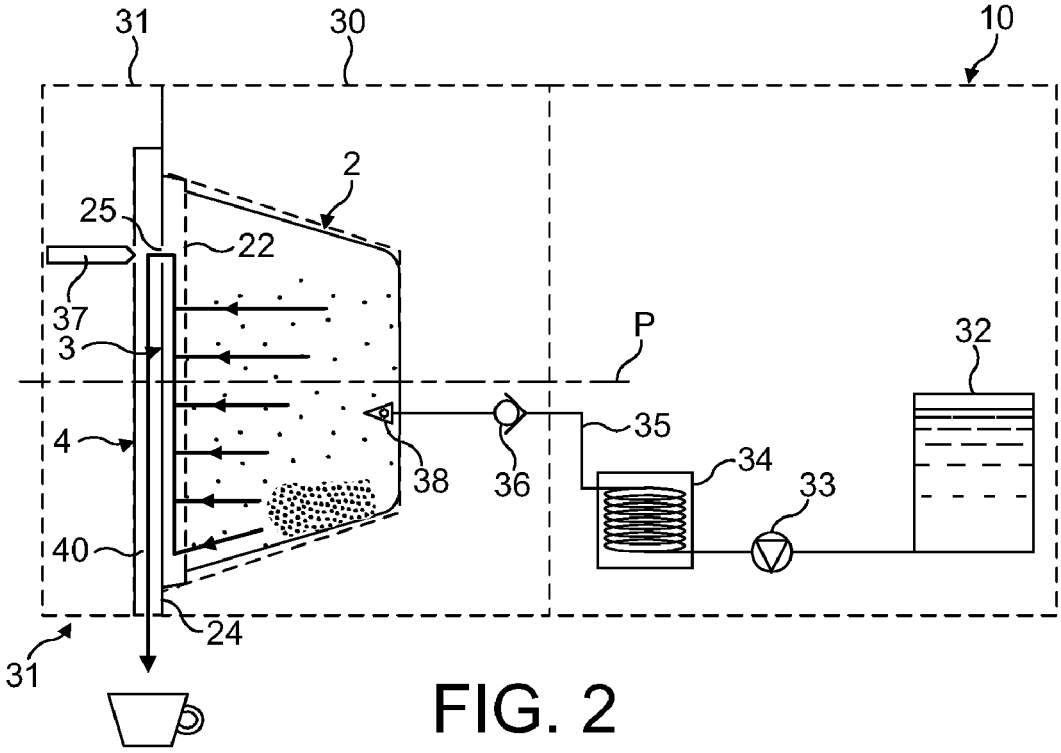
FIG. 2 is a schematic illustration of a the capsule brewing system of FIG. 1 during brewing of the capsule of the invention.
Figure 3:
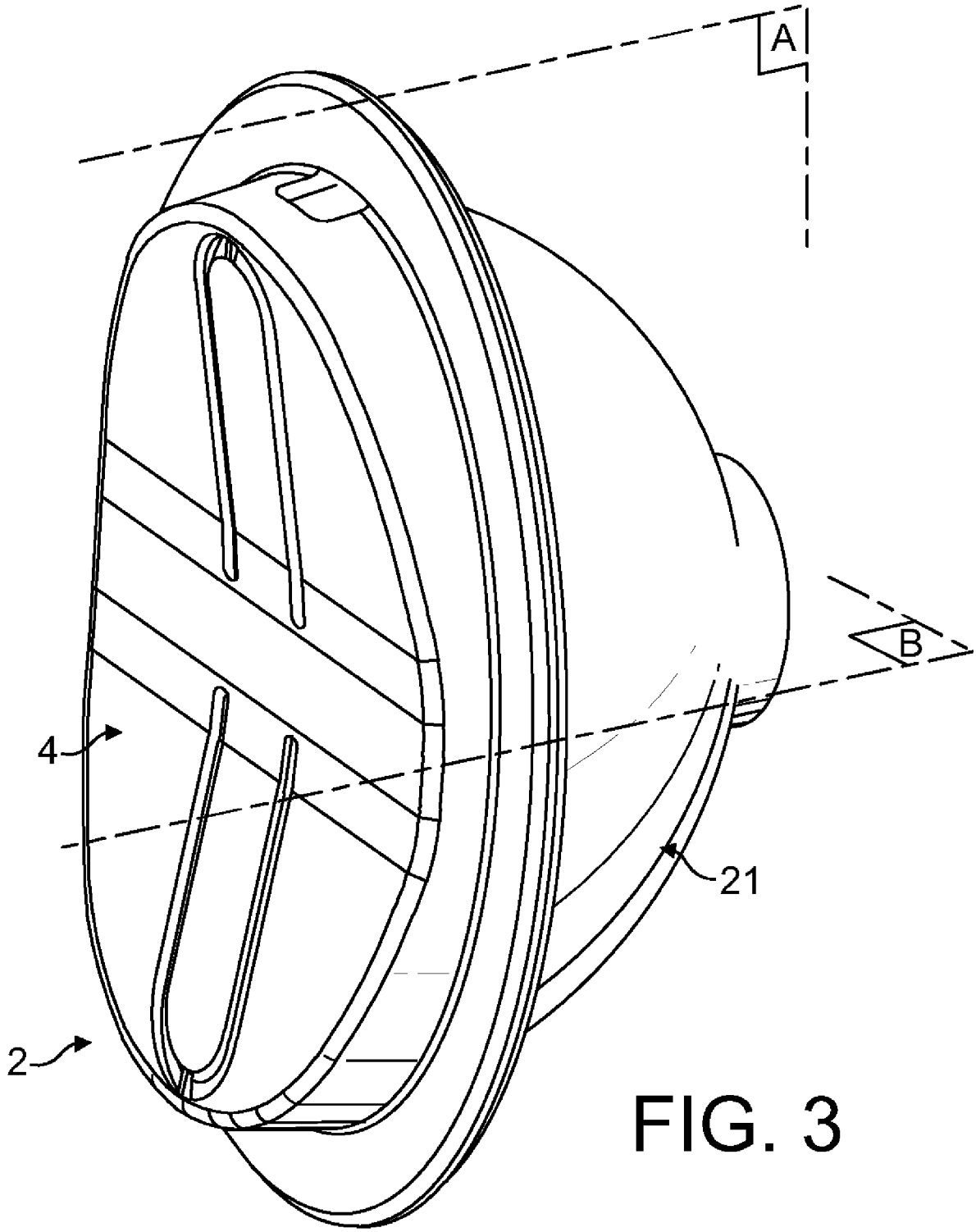
FIG. 3 illustrates a perspective view of a capsule according to a second embodiment of the invention.
Figure 4:
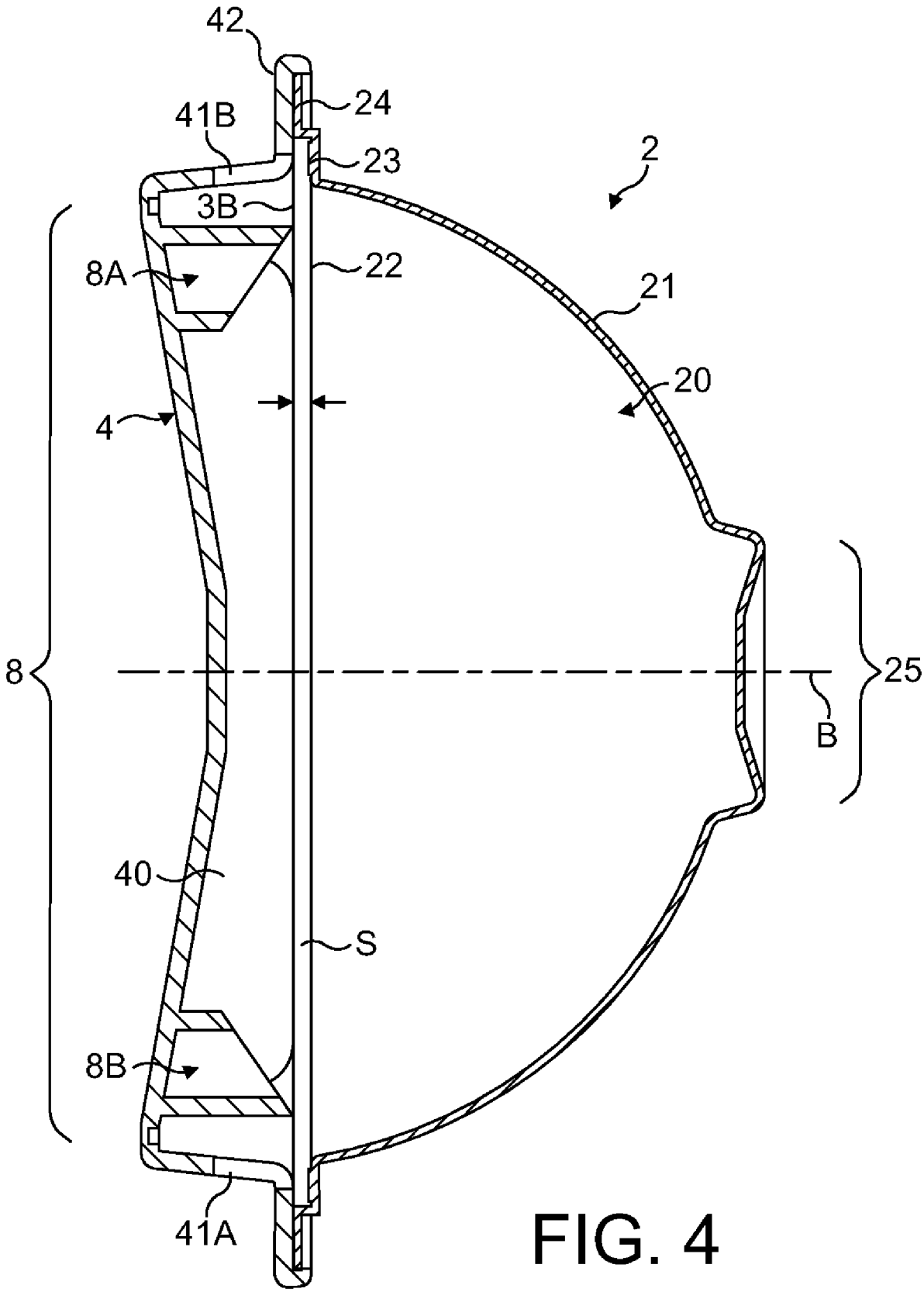
FIG. 4 is a cross-sectional view of the capsule of FIG. 3 along median vertical plane A.

Importantly, in the brewing operation shown in FIG. 2, the capsule finally comprises an overflow wall 3 with an overflow aperture 25 placed at least above the median horizontal plane P of the enclosure. As also apparent in FIG. 2, the filtering wall 22 and the overflow wall 3 are spaced apart a short distance sufficient to create an interstitial space "s" that is supposed, without being bound by theory, to work as a sort of "siphon" that can promote the upward motion of the denser beverage portion that is predominantly localized in the bottom of the enclosure.

In relation to FIG. 2, the method of the invention works as follows. A capsule is inserted in the brewing device and the capsule handling members are closed about the capsule to position it with the sealing wall being substantially vertically oriented. An overflow aperture is created by the perforating means 37 that punctures the sealing wall 3 and is withdrawn to leave the aperture opened. On the opposite side of the capsule, the fluid injection member is introduced in the capsule's enclosure. Hot water is thus injected in the capsule at relatively low pressure, preferably, at a pressure not exceeding 0.2 bar. Hot water slowly fills the capsule in and submerges the beverage ingredients in the enclosure. The brewed beverage is filtered through the filtering wall 22. A denser portion 5 of the beverage may tend to settle in the bottom of the enclosure; which portion is also filtered through the filtering wall since it is properly placed adjacent this portion. The denser beverage is evacuated through the interstitial space "s" as caused by the variation of pressure between the lower part of the space and the upper part of said space therefore acting similarly to a "siphon". The rest of the beverage is also filtered also by passing through the filtering wall at different vertical levels up to the upper level of the fluid in the enclosure and is evacuated to the overflow aperture 25.

It should be noted that the overflow aperture should preferably be placed above the ¾ of the total height of the enclosure and even preferably be placed above the ⅘ of the total height of the enclosure; thus ensuring a more complete submergence of the beverage ingredients and a slower evacuation of the beverage from the enclosure which favours a better infusion process.

The "total height" of the enclosure is meant to be the total distance separating the lowermost point of the enclosure to the uppermost point of the enclosure when the capsule is positioned in the beverage machine ready for the brewing operation. In a possible mode, the filtering wall can be substantially equal to the total height of the enclosure.

It can be noted that a "direct flow" can be obtained where the brewed liquid is dispensed directly into the recipient 6 (e.g., cup, mug and the like). By "direct flow", it is meant that the outlet is arranged in respect to the brewing device so that the brewed liquid does not encounter any permanent device part when leaving the outlet. In other words, the outlet is placed sufficiently low and laterally spaced from the capsule handling members to avoid any significant contact of the liquid with these members when released.

The principle of the brewing method according to FIGS. 1 and 2 encompasses different variants and equivalences.

For instance, the overflow wall 3 may not be perforated but may be pre-opened by a pre-cut overflow aperture. The pre-cut overflow aperture means an aperture which has already been made at the manufacturing stage of the capsule. Freshness of the beverage ingredients may so be preserved by different means such as by an airtight closed cover with a sealed outlet that is unsealed just before brewing or by the use of an airtight overwrap package that encloses the capsule.

The capsule may also be conceived without the cover 4 and its channelling function. In which case, the front handling member 31 may be designed to collect the brewed liquid as it passes the overflow wall 3 and travels down to the recipient.

A second embodiment of the capsule of the invention is illustrated in relation to FIGS. 3 to 8. These figures illustrate a variant of the beverage capsule 2 for carrying out the method of the invention.

The beverage capsule 2 comprises an enclosure 20 for containing one or more beverage ingredients. The enclosure 20 is defined by the assembly of a cup-shaped shell 21 and a filtering wall 22. A overflow sealing wall 3B closes the shell 21 hermetically and will serve the purpose of the overflow wall as will be explained later on. The capsule further comprises a cover or lid 4 with a peripheral rim that is attached to the peripheral rim 42 of the housing 21. The connection between the lid and housing can be made by gluing, welding, snap fitting and any combinations thereof.

The overflow sealing wall 3B may be constructed of a rigid, semi-rigid, or non-rigid material, or combinations thereof. Suitable materials include, but are not limited to, plastics, PET, aluminum foil, polymeric film, paper, and the like. In a preferred mode, the wall is a flexible membrane made of monolayer or laminate with a gas barrier and oxygen is substantially removed from the enclosure during manufacturing by inert gas flushing or a similar technique, therefore, to maintain freshness of the beverage ingredients before use.

The lid 4 serves as a support for at least one puncture means or puncture indication means 8. Indeed, the capsule comprises at least one puncture means 8 positioned relatively to the sealing wall 3B to be able to produce at least one overflow aperture in the sealing wall. In the preferred example shown here, the capsule comprises two puncture means 8A, 8B. The need for two puncture means on the capsule will become apparent in the following description, but in simple terms, it enables to use the capsule in two possible orientations in the brewing machine and so provide more convenience to the user in the handling of the capsule.

The puncture means are positioned in an off-centred arrangement relative to the median plane B representing the horizontal plane passing by the centre of the enclosure 20 when the capsule is placed in operation in the brewing device 3.

In this preferred mode, the capsule comprises two series (respectively referenced "A" and "B") of one puncture means 8A, 8B and of one beverage outlet 41A, 41B; each series being placed offset relative to the median centre plane B of the sealing exit wall and opposed to each other. In particular, the two series 8A, 41A; 8B, 41B of said puncture means and said outlets, are placed symmetrically with respect to a median plane (B) passing through the centre plane of the sealing exit wall.

The main advantage of such configuration is that the capsule can be so oriented in two possible orientations, at about 180° one another, thus facilitating insertion and placing of the capsule in the machine. Of course the number of series could exceed two, preferably an even number, for instance, four series which are grouped by two at 90° degrees from each other, so that it offers four different possible orientations in the machine.

The capsule further comprises a filtering wall 22 that is spaced apart a short distance relative to the sealing wall in order to leave an interstitial space "s" there between. The filter wall can be attached by any suitable connection means, such as welding, gluing, snap fitting or any equivalents, to a peripheral stepped portion 23 of the housing. The filter media can be constructed from a variety of materials including, but not limited to, plastic foil, non-woven polyester, polypropylene, polyethylene, paper materials, and combinations thereof.

The beverage flow conducting means 40 can preferably be positioned adjacent and outside relative to the sealing exit wall. As a result, the capsule can be oriented vertically, e.g., its exit sealing wall being vertically oriented, in order for the flow to be directed straight down to the cup via the beverage flow conducting means 40 and the beverage outlet. One additional advantage is that the capsule can be "direct flow" in the sense that the beverage that leaves the machine falls down directly into the cup without touching any part of the machine. The benefits are so less taste cross-contamination and reduced cleaning.

According to an aspect of the invention, the puncture means 8A, 8B and the beverage outlets 41A, 41B are respectively placed at two opposite off-centred sites relative to the centre or median plane B of the sealing exit wall or enclosure. By the fact that the beverage leaves the enclosure at approximately the highest point and leaves the beverage outlet at approximately the lowest opposite point of the capsule, the combined advantage is that the capsule can both be held in a vertical orientation for an improved brewing and can produce a "direct flow" of the beverage into the cup.

Preferably, one of the beverage outlets 8A, 8B, depending on the capsule's orientation in the brewing device, becomes so oriented downwards to release the beverage in a direction that is substantially orthogonal to the direction at which the beverage is released out of the overflow location. This configuration enables to orient the capsule in the machine such that the beverage is released in a straight downward direction into the cup thus favouring a "direct flow" without contact with the machine.

In a preferred mode, the flow conducting means 40 is shared by the two series A, B at once. As a result, the construction of the capsule is rationalized and less costly to produce.

Figure 5:
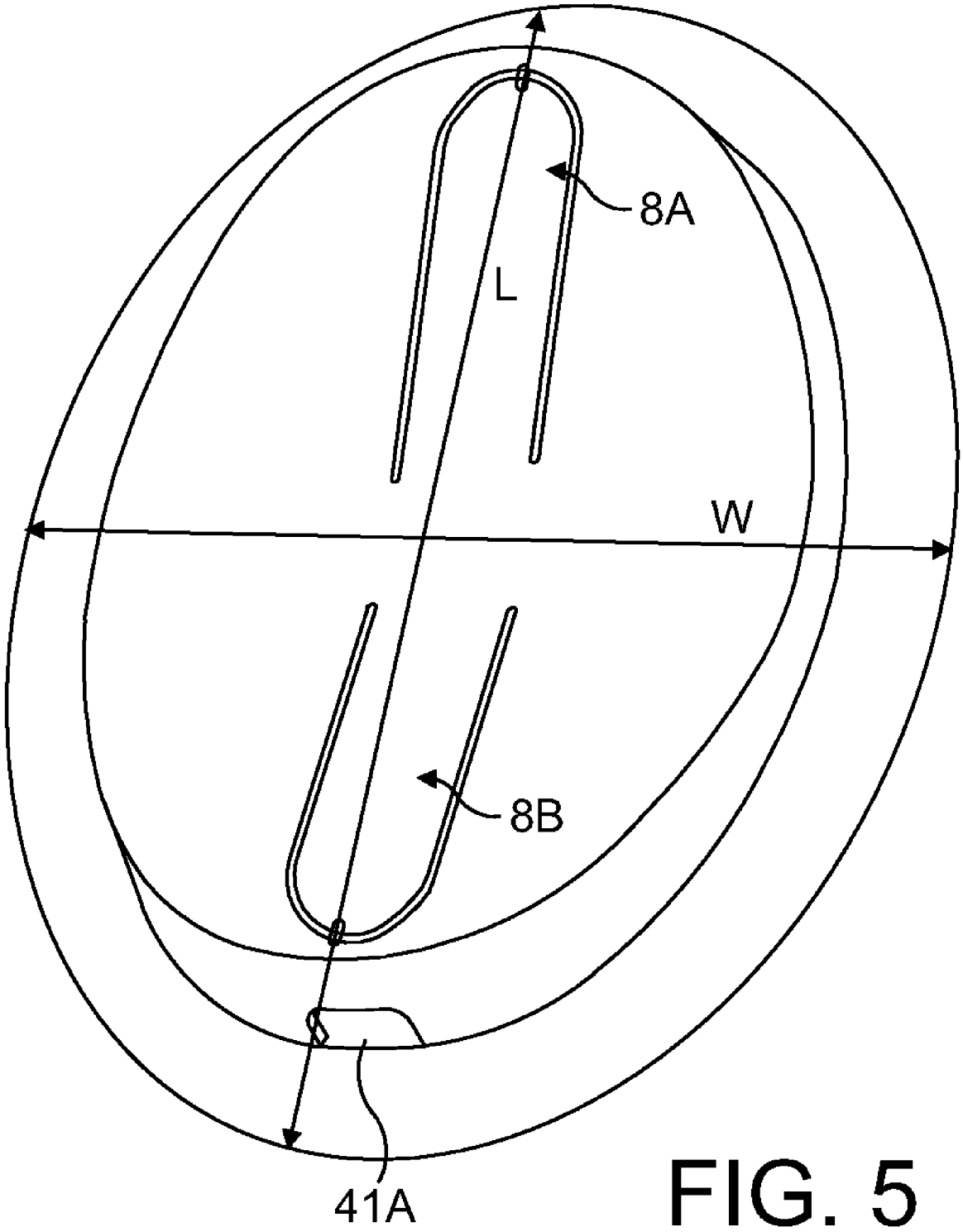
FIG. 5 is a perspective external view of the cover or lid of the capsule of FIG. 4.
Figure 6:
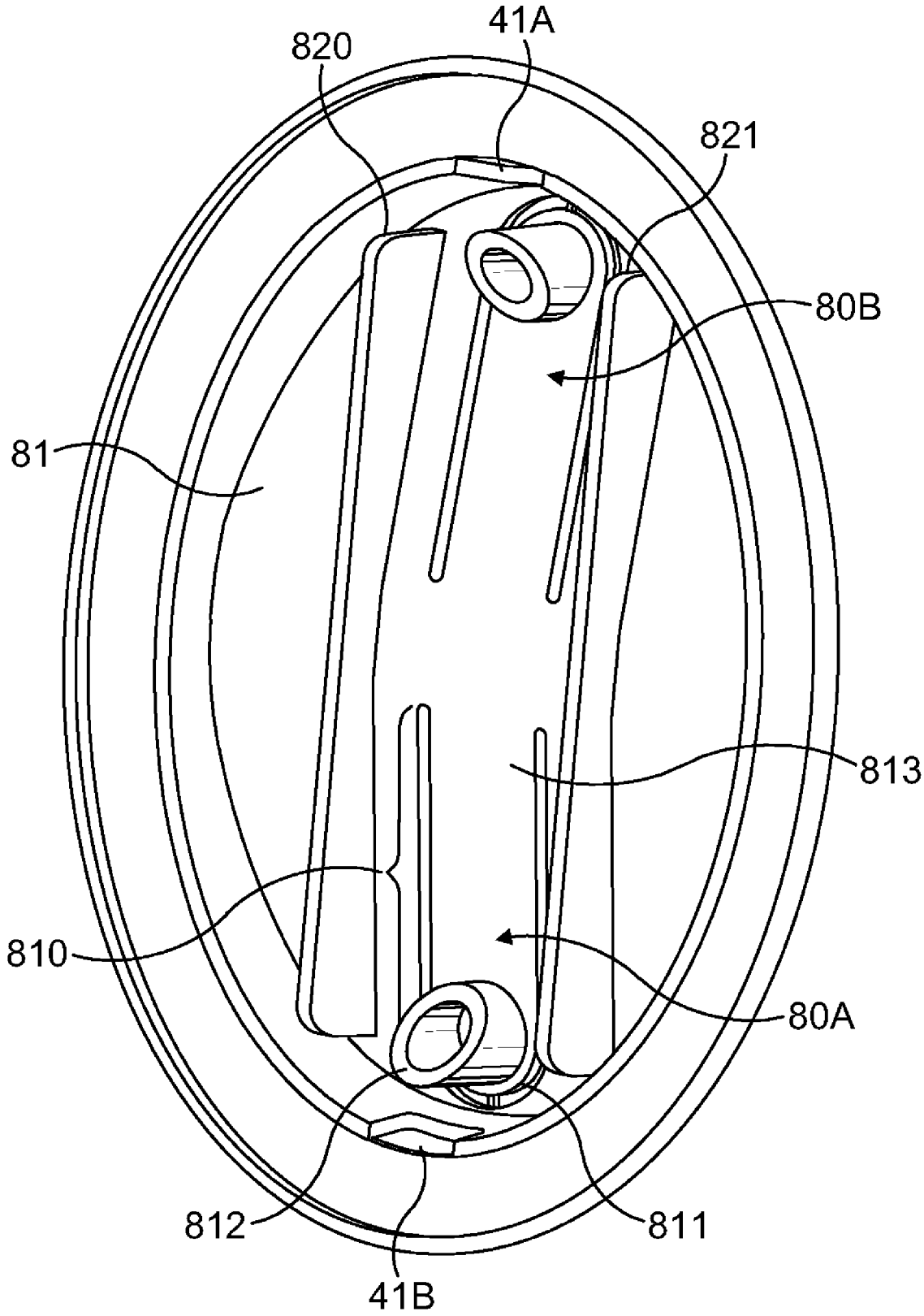
FIG. 6 is a perspective internal view of the cover or lid of the capsule of FIG. 5.
Figure 7:
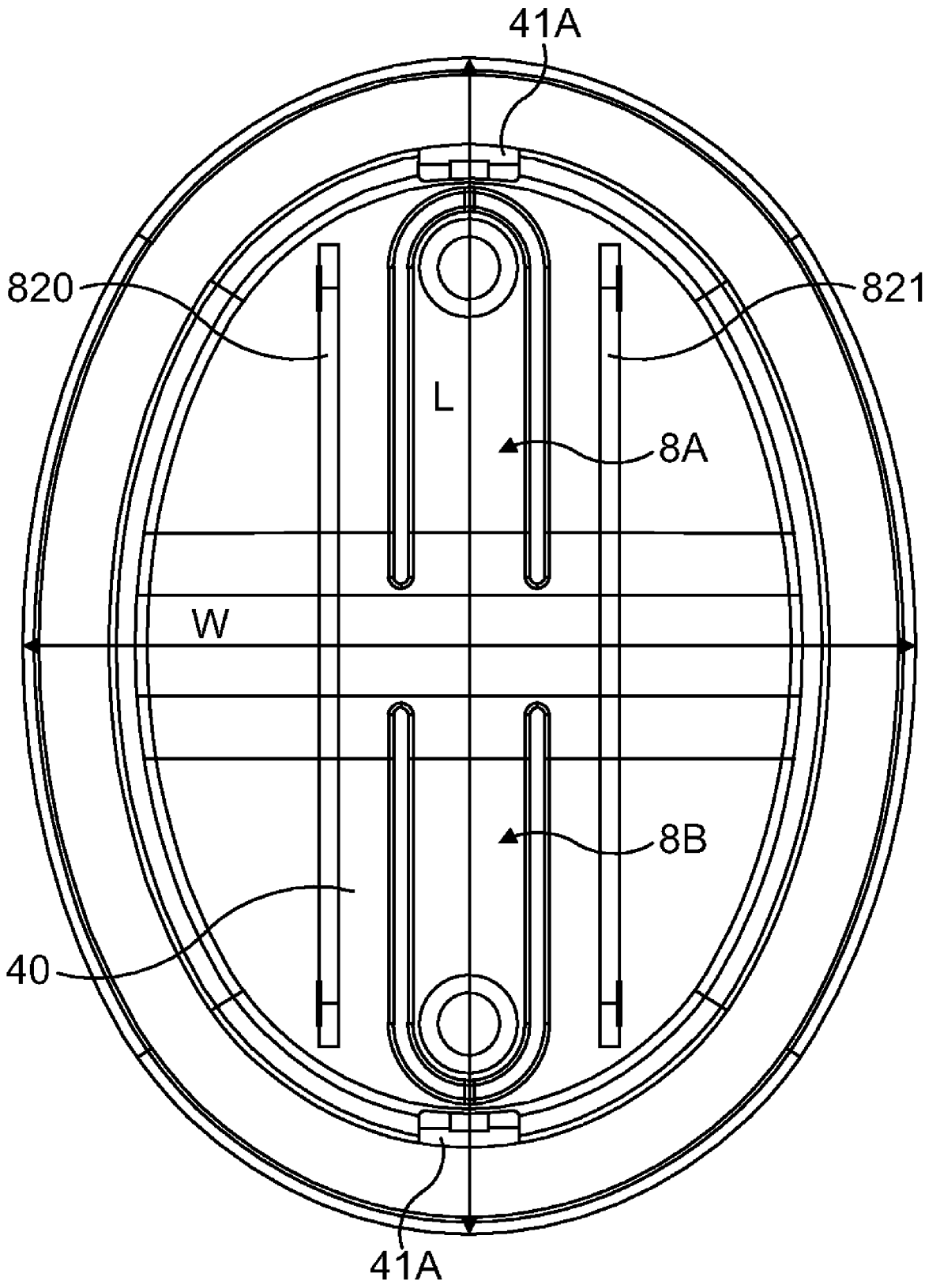
FIG. 7 is a plane internal view of the cover or lid of FIG. 5.

As more particularly shown in FIG. 5 or 6, the capsule can also be shaped to promote and indicate to the user a particular direction for insertion into the brewing device. For instance, the capsule, more particularly the cover, can be provided with an elongated shape having an axial distance L and a shorter transversal distance W; wherein the at least one puncture means 8A, 8B and at least one outlet 41A, 41B are placed substantially along the axial distance.

The puncture means 8A, 8B comprises two spring-biased mechanical perforating members that are better shown in FIG. 6. Each member is formed of one resilient plastic tongue 810 made integral with the rest of the lid. The tongue supports at its flexure end 811 an inner spike 812 sufficiently large to create an overflow aperture of sufficient section in the sealing wall. At its attached end 813, the tongue connects integrally to the surface of the transversal surface of the lid. The two puncture means and outlets are thus aligned along the longer axis of the lid.

The puncturing means 8A, 8B as described and illustrated can take many other equivalent configurations and they should not be limited to the form as described and shown. For instance, the resilient plastic tongue 810 can be replaced by a spring which is not necessarily made of one piece with the cover. The inner spike can take other shapes. For instance, it could be formed by the conjunction of several separate needles capable of forming multiple small openings. Blades of different shapes such as could also replace the spike triangular, trapezoidal, rectangular, serrated or sinusoidal, etc.

In the inner recess 81 of the lid, internal portions of wall 820, 821 are provided that run parallel to each other and on each side of the puncture means. The portion of wall 820 extends inwardly and perpendicularly to the recess 81 and comes proximate to the sealing wall 3. They also preferably run from a point proximate to the two outlets 41A, 41B in order to form the inner channel 40 capable of guiding the flow of brewed liquid from the overflow aperture to its respective outlet placed opposite the lid. The walls 820, 821 form a guiding channel for the beverage but also rigidify the lid. The outlets 41A, 41B can serve two functions depending on their position during brewing: a first delivery function when the outlet is placed at the bottom of the capsule and a second air venting function when the outlet is placed at the top of the capsule during brewing. Of course, the guiding channel may be differently designed, for example, it can be formed of a tubular member which is inserted between the cover 4 and the sealing wall 3B or which can be an integral part of the cover itself. The tubular member could also extend beyond (above and below) the limits of the cover itself to form portions of duct to help guide the brewed liquid to the cup.

Figure 8:
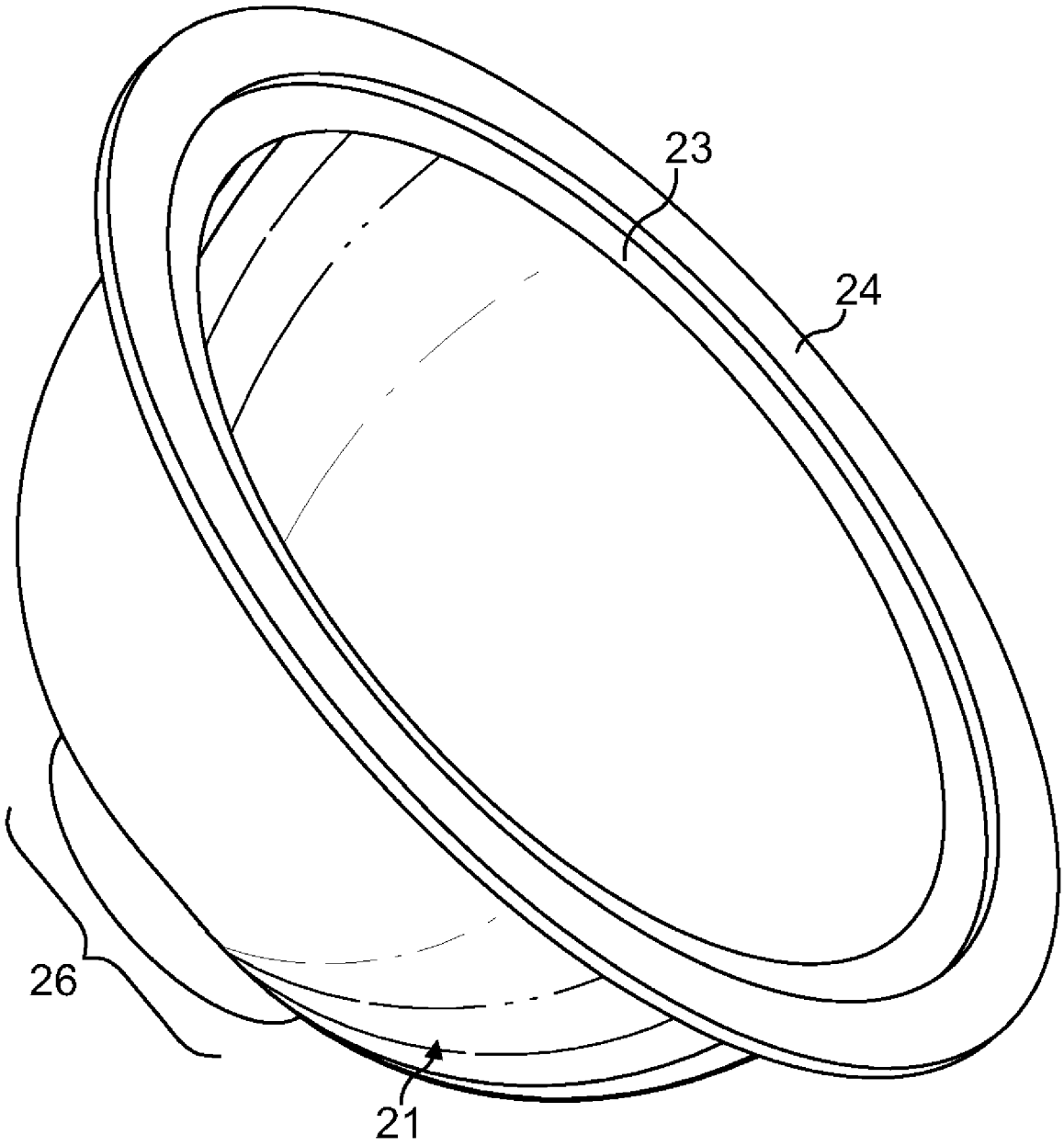
FIG. 8 is a perspective view of the cup-shaped housing or shell of the capsule of FIG. 5.

FIG. 8 shows the capsule housing or shell 21. In particular, the housing can be formed of thermoformed; blow moulded or injected plastic such as PP or a PP laminate comprising an oxygen barrier or any suitable food grade polymer or of deep drawn aluminium or aluminium-polymer laminate. The housing has a peripheral rim that extends as a flange to constitute a substantially flat sealing portion onto which can be sealed the sealing wall and snap fitted and/or sealed the cover 4. A small step 23 is conceived radially inward to the rim to receive the filter wall that can be sealed or otherwise connected to the flat radial portion of the step. The depth of the step depends on the thickness of the filter wall and on the control of the interstitial space to provide the siphon effect. For instance, the filter wall can range from 0.1 to 1.5 mm whereas the depth of step ranges of from 0.2 to 5 mm whereas the interstitial space ranges of from 0.1 to 3.5 mm.

At the rear of the housing 21, the wall of the housing can comprise a raising zone 26 that constitutes the injection region for the introduction of the fluid in the capsule. The raising zone is so conceived to resist to compressive forces of the injection device 38 and to puncture at its centre more easily.

It can be noted that the puncture means could be replaced by mere puncture indication means, for instance, at least one hole provided through the lid that is placed strategically above the median plane of the enclosure to guide an external perforator of the brewing device in a way similar to the embodiment of FIG. 1.

In another variant that is not shown, the capsule can have a cover with more than two puncturing means or puncture indications means. For instance, the cover can be round and comprise four puncture means which are distributed radially at respectively 0, 90, 180 and 270 degrees on the cover thus offering four possible insertion positions for the capsule in the beverage device.

FIGS. 9 to 12 refer to the brewing process and related machine system of the capsule of FIGS. 3 to 8. The advantages of the "vertical" arrangement of the capsule in the brewing device becomes even more apparent in relation to these figures in relation to the convenience in the handling of the capsule from insertion to removal.

Figure 9:
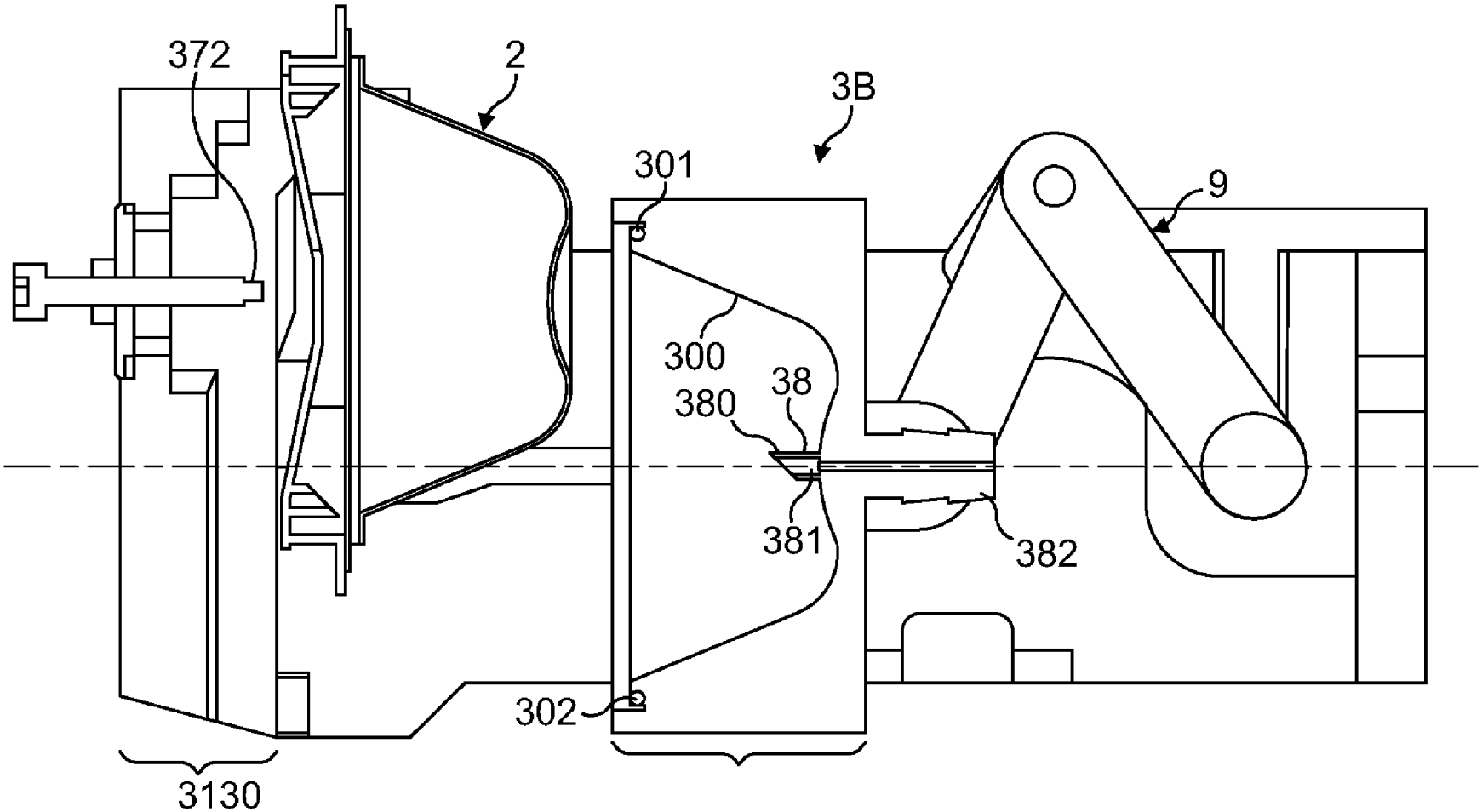
FIG. 9 shows the phase of insertion of the capsule of FIGS. 3 to 8 in the brewing device.
Figure 12:
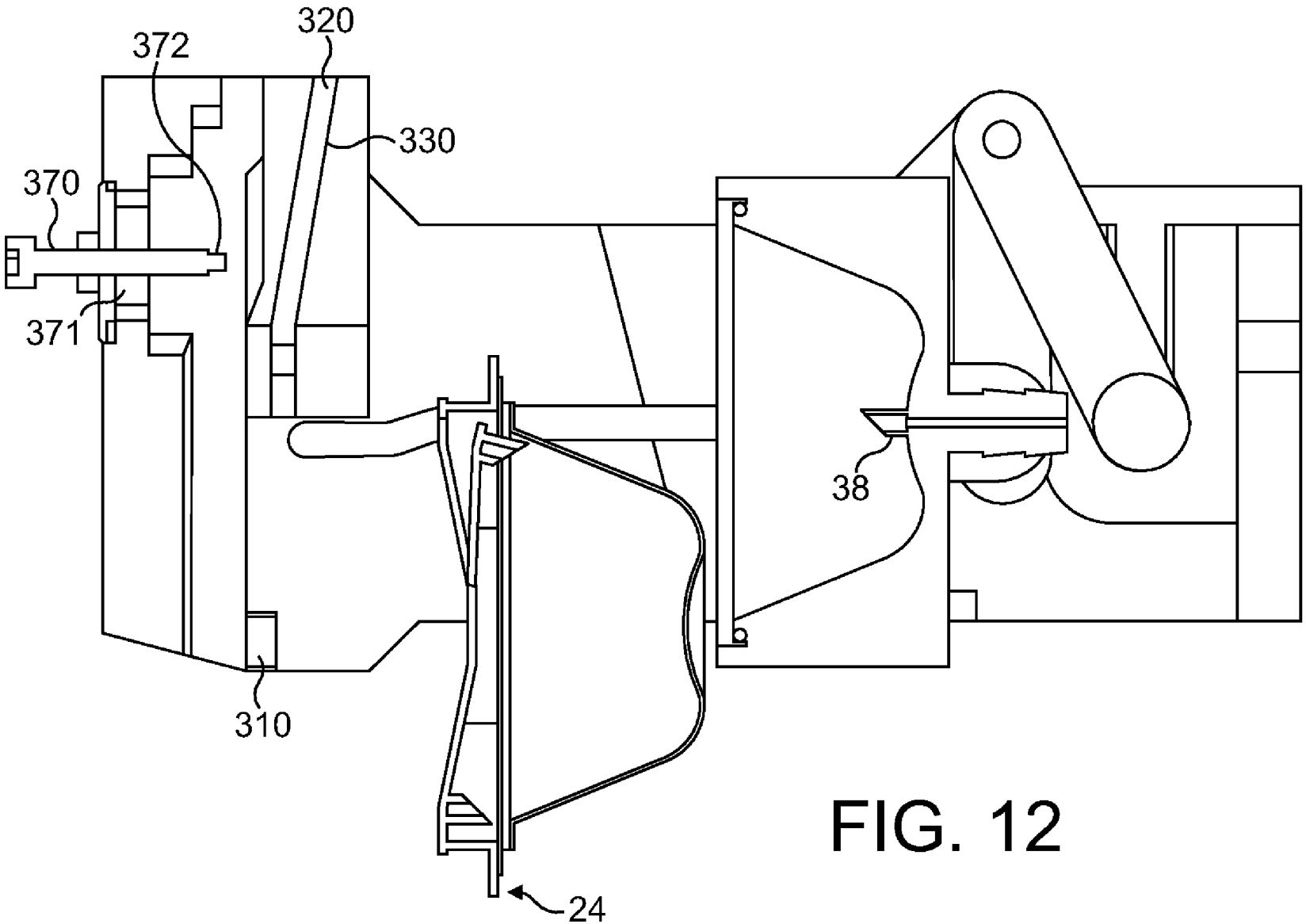
FIG. 12 shows the phase of removal of the capsule from the brewing device.

An exemplary of a brewing module will now be depicted in more details in relation to FIGS. 9 and 12 that represent respectively the insertion and ejection modes of the capsule. The brewing module 3B comprises two main capsule handling members 30, 31 that cooperate in engagement to close about the capsule 2. A front handling member 31 can be fixed relative to the brewing device (not entirely depicted) whereas rear handling member 30 is mobile relative to member 31. One can note that this could be the opposite; the front member could be mobile and the rear member fixed or both could be mobile. The front handling member has guiding insertion means 320 that enable to insert the capsule in the brewing device. Means 320 can be a lateral member comprising two lateral slots 320 placed on each side of the capsule to engage the rim 24 of the capsule. The slot can be slightly slanted toward the front handling member in a manner to progressively bring the capsule near the front handling member as capsule progressively falls down by gravity in the device. A retaining means 310 is provided at the lower part of the handling member for the capsule to be retained in place once inserted in. A lower portion of the rim 24 of the capsule thus engages an abutting portion of means 310.

In the front handling member is provided a mechanical pusher 370 that is slidably mounted through a bearing portion 371 of the handling member. The mechanical pusher can be associated to an actuating means such as an electromechanical solenoid, a cam or any equivalent means (not shown) that can move the mechanical pusher back and forth through the bearing portion. The mechanical pusher is so moveable in two positions; a first retracted position of FIG. 9 in which the free end 372 of the pusher is kept away from the capsule when placed in the device and a second extended position shown by FIG. 11 in which the pusher actually engages the upper puncture means 8.

The rear handling member 30 comprises a housing 300 having a shape that is substantially complementary to the shell 21 of the capsule. The housing includes at its bottom end a fluid injection member 38 that can be, for instance, a sharp needle 380 traversed by a fluid conduit 381. At the rear of the rear handling member is located a gland that is connected to a fluid tubing (not shown) linked to the fluid system of the beverage device. The housing 300 has at its open end a small peripheral recess 301 in which is lodged an annular seal joint 302 that makes the fluid tightness against the back of the stepped rim 24 of the capsule when closing is carried out.

The rear handling member 30 can be moved along a substantially horizontal path by means of a toggle lever system 9. This system is not going to be described in detail here since many different mechanical or hydraulically assisted closing means can be envisaged by a man skilled in the art to move the handling member in a closing arrangement about the capsule in conjunction with the front handling member.

Figure 10:
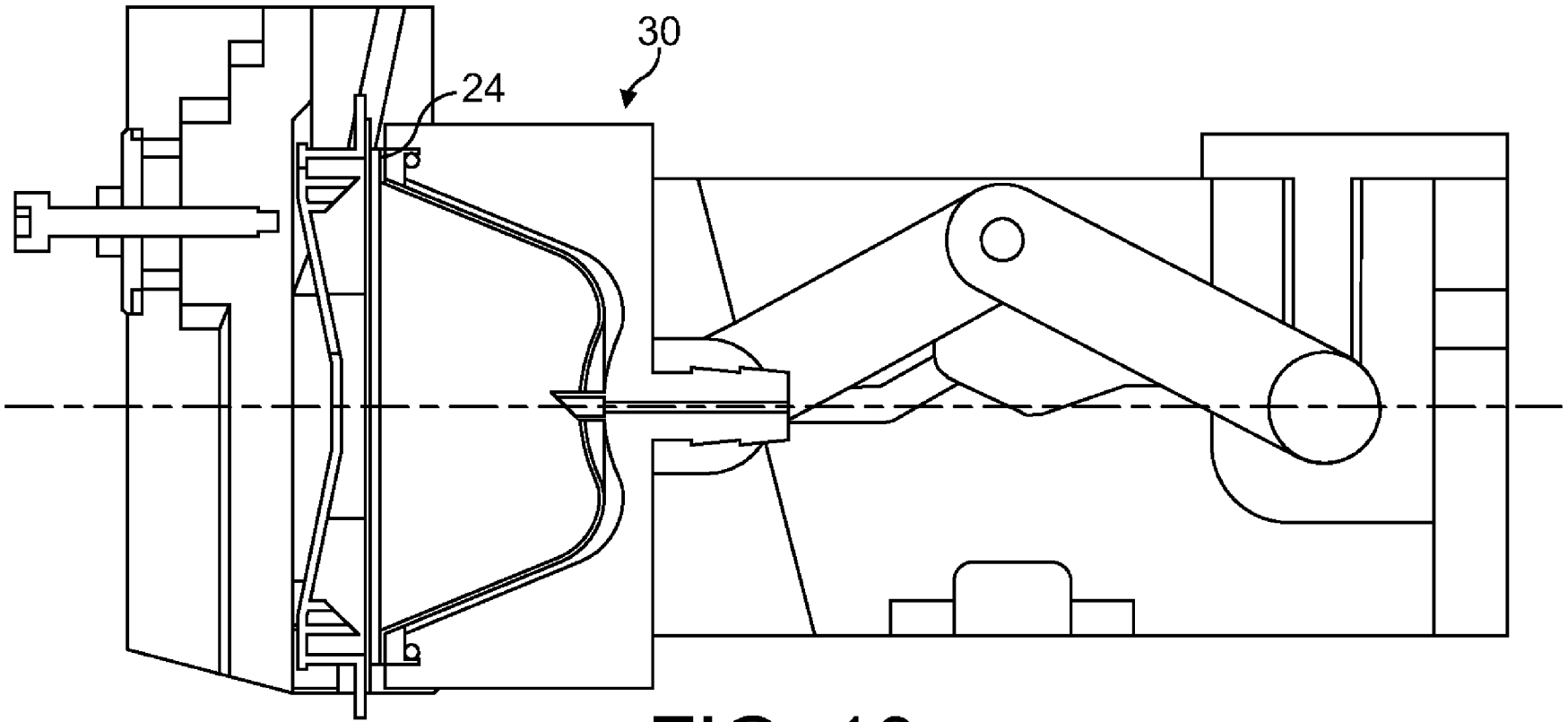
FIG. 10 shows the phase of closing of brewing device about the capsule.

FIG. 10 shows the rear handling member 30 being displaced by the toggle lever system 9 that extends toward a close position of the brewing device.

Figure 11:
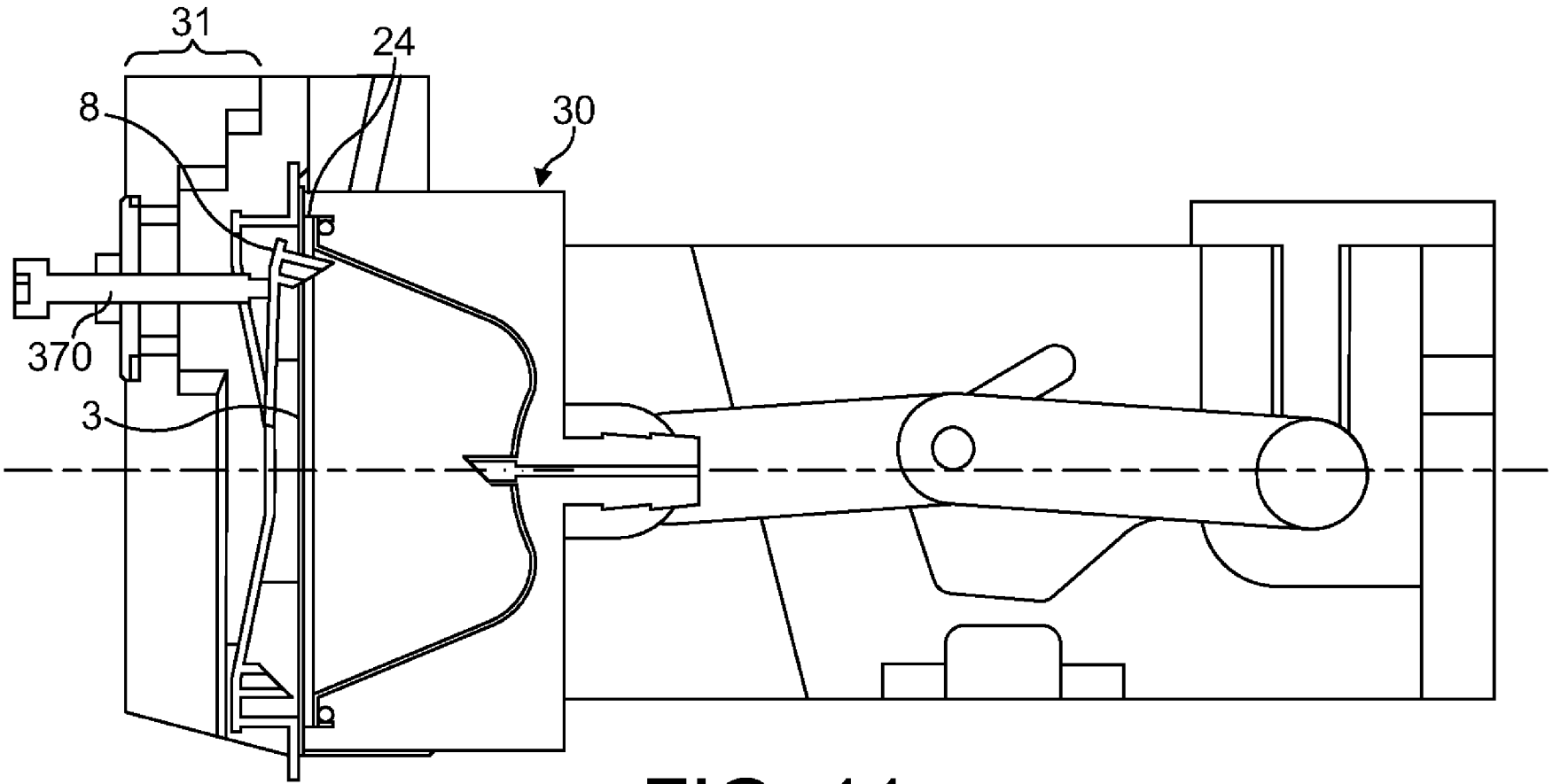
FIG. 11 shows the phase of creating the overflow aperture of the capsule before brewing in the brewing device.

In FIG. 11, when the handling members have been closed about the capsule and the capsule is tightly secured along its stepped rim 24, the mechanical pusher 370 is activated in the deployed position to push the upper puncture means 8 against the sealing wall 3 of the capsule. This results in the sealing wall being locally punctured with an overflow aperture. The mechanical pusher is then moved to its retracted position thus leaving the aperture fully disengaged. In the next step, the brewing can start and fluid can be injected in the capsule for brewing the ingredients as already explained.

In FIG. 12, the handling members open, i.e., the rear handling member is retracted, which causes the capsule to be slightly pulled back and thus it can fall down by gravity and be discarded.

Figure 13:
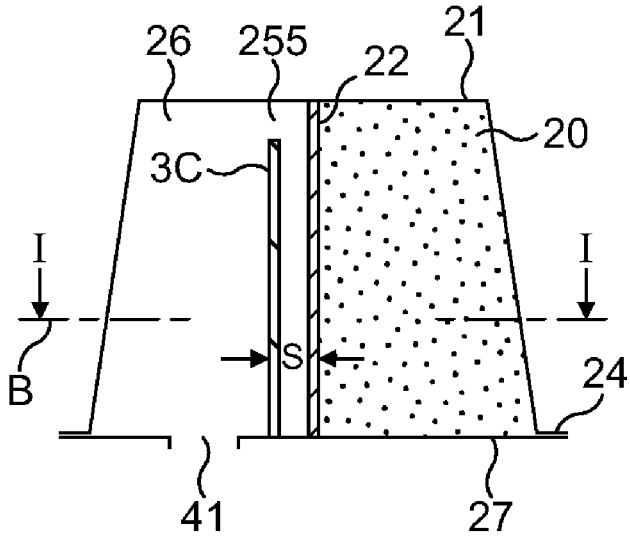
FIG. 13 shows a cross section view of a trunconical capsule according to a third embodiment of the invention.
Figure 14:
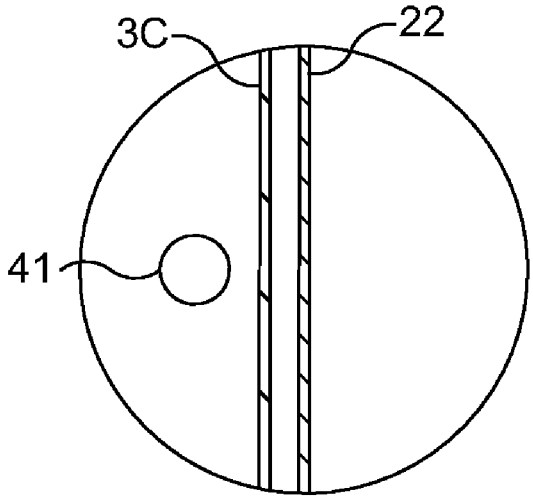
FIG. 14 shows a cross sectional view in direction I-I of median plane B of the capsule of FIG. 13.
Figure 15:
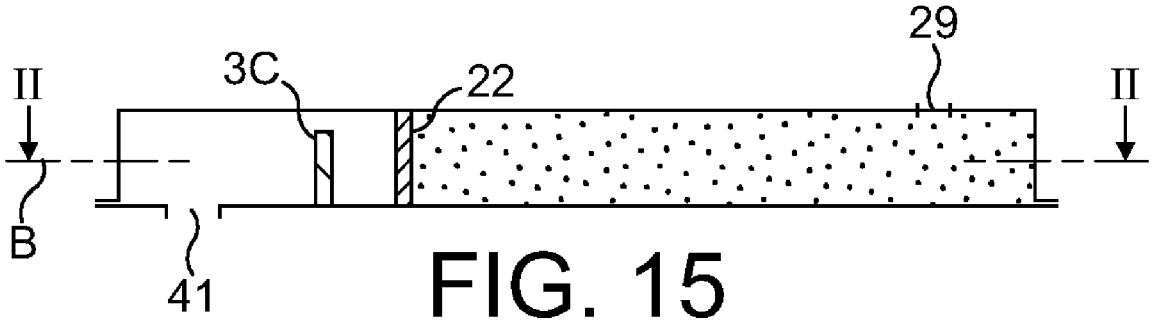
FIG. 15 shows a cross sectional view of a rectangular capsule according to a fourth embodiment of the invention.
Figure 16:
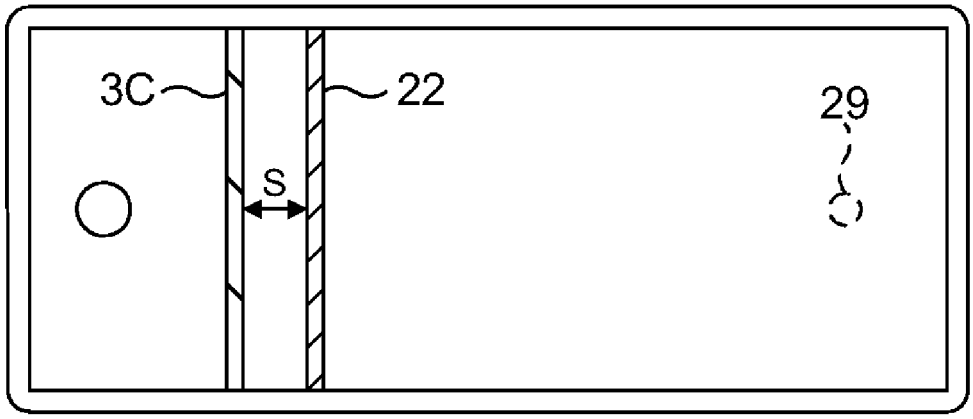
FIG. 16 shows a cross sectional view in direction II-II of median plane B of the capsule of FIG. 15.

FIGS. 13 and 14 illustrate another variant of the capsule of the invention that is conceived to be brewed while being positioned "horizontally" in the brewing machine. The general brewing principle remains the same as in the preceding examples. The capsule comprises an enclosure 20 containing the one or more ingredients to be brewed. The enclosure is demarcated by the trunconical shell 21, a lower wall 27 and an inner filter wall 22. The filter wall transversally splits the inner volume of the shell in two parts; the enclosure and a second beverage collecting volume 26. The filter wall is placed so that it runs from the two top/bottom ends of the enclosure so that the denser liquid that tends to stay near the bottom can be removed through the filter. The lower wall 27 can be a circular portion that is attached to the rim 24 of the shell 21 such as by crimping, welding, gluing or combinations thereof. It comprises an overflow wall 3C that rises upwardly inside the shell in front of the filter and leaves an overflow aperture 255 in a region close to upper bottom of the shell 21. The overflow wall is spaced of a short distance "s" from the filter wall 22. A beverage outlet 41 is provided in the collect chamber 26 and through the bottom wall 27. The beverage capsule of FIGS. 15 and 16 is brewed in an "horizontal" orientation, i.e., with the bottom wall and outlet 41 facing downwardly. Water is injected at low pressure in the enclosure, preferably from the bottom wall. The brewed liquid flows through the filter wall 22 and is forced to pass the overflow aperture 3C to the collect chamber 26 then down to the outlet 41.

FIGS. 15 and 16 illustrate another variant of the capsule that is designed to be brewed according to the method of the invention. The capsule possesses the same features as the capsule of FIGS. 13 and 14 except that it is of a rectangular shape. The capsule also comprises an injection point 29 that can be a pre-scored or weakened portion for the introduction of a water nozzle of the brewing device. The weakened zone can be a plastic part that breaks when forced by the nozzle's introduced therein.

Figure 17:
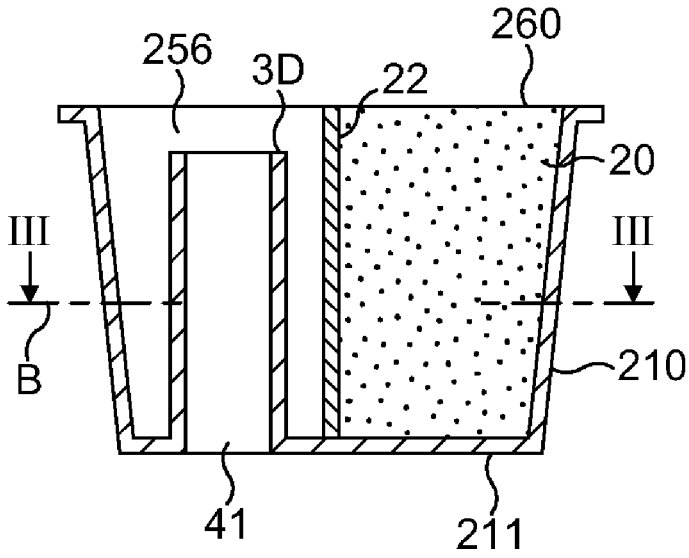
FIG. 17 shows a cross sectional view of a capsule according to a fifth embodiment.
Figure 18:
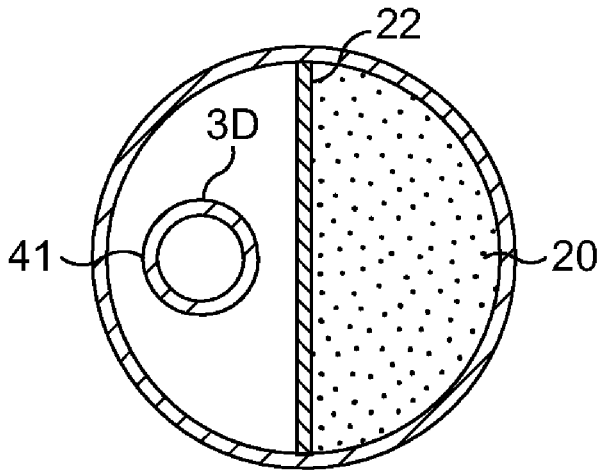
FIG. 18 shows a cross sectional view in the direction III-III of median plane B of the capsule of FIG. 17.

FIGS. 17 and 18 illustrate another possible embodiment of capsule that is designed to be brewed according to the general principle of the invention. In this embodiment, the overflow wall is a funnel 3D that prolongs the outlet 41 inside the capsule. The funnel remains shorter than the total height of the enclosure to leave an upper gap 256 between the end section of the funnel and the upper surface of the capsule to constitute the overflow aperture. It can be noted that the supporting structure of the capsule can encompass many variants such as the one illustrated in this example. Here, the capsule has an inverted U-shaped shell 210 with its bottom wall 211 forming the bottom of the capsule; and is closed by a cover 260. The shell is delimited in two volumes by a planar vertically oriented filtering wall 22. The injection of water in the enclosure 20 that contains the ingredient can be carried out either through the cover 260 in which case the cover is preferably a puncturable membrane or through the shell 210 (i.e., in the side or bottom).

Figure 19:
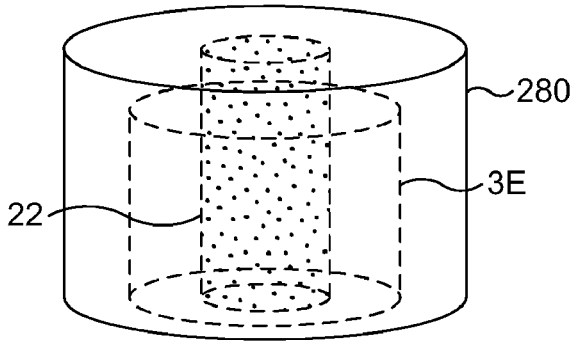
FIG. 19 shows a schematic perspective view of the principle capsule according to a sixth embodiment.
Figure 20:
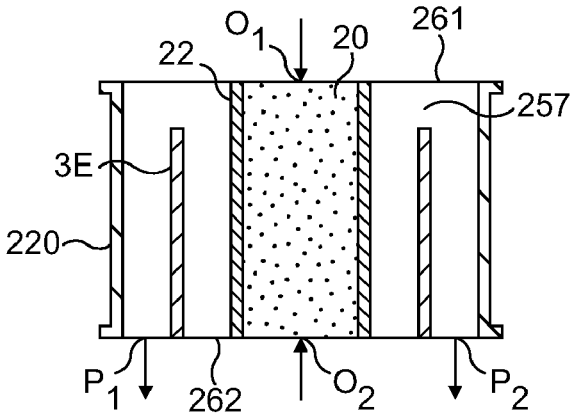
FIG. 20 is a cross sectional view of the capsule of FIG. 19.

FIGS. 19 and 20 illustrate another variant in which the capsule is made of concentric tubular elements of progressively decreasing diameters (i.e., respectively, from a first to a third portion). The outer body or housing of the capsule is made of a first tubular body 220. The overflow wall is made of a second tubular portion 3E of smaller diameter and smaller height. The filtering member 22 is made of a third tubular portion of smaller diameter and substantially equal height as the outer body. This third tubular portion can be, for instance, a spongy or paper or woven, or nonwoven or sintered plastic tube or a combination thereof. The beverage ingredient fills the interior of the third tubular portion that so constitutes the enclosure 20. The outer body can be sealed on its upper and lower sides by respectively upper and lower lids 261, 262. Owing to the smaller height of the second tubular body, an overflow aperture 257 is performed that can let brewed liquid pass after it has been filtered through the filtering tubular portion 22. Of course, the lower lid 262 can be made integral with the overflow wall such as in injected plastic. The lower lid, overflow wall and first portion could be made of an integrally moulded plastic as well. The first portion could have a non-tubular shape as well. The points O1, O2 represent the possible water introduction sites in the capsule. As it shows, the water can be introduced at the upper or lower centre of the capsule through the upper or lower lid straight in the enclosure. The points P1 P2 represent the possible exit point for the brewed beverage. The beverage can possibly be dispensed from the capsule along any suitable location between the first and second tubular portions through the lower lid 262.

Figure 21:
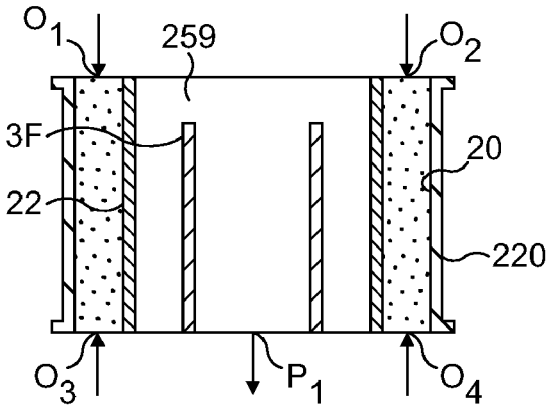
FIG. 21 is a cross sectional view of a variant of the capsule of FIG. 20.

FIG. 21 illustrates another variant of a concentric arrangement of tubular portions of progressively decreasing diameters (i.e., respectively, from a first to a third portion) that differs slightly from the previous in that the enclosure 20 is provided at the outermost annular volume between a first outer portion 220 and a second filter tubular portion 22. In this embodiment, a third portion of tube of smaller diameter and smaller height is placed at the centre to force overflow of the brewed beverage. Points O1, O2, O3, O4 represents the possible inlet fluid sites. Point P1 represents the possible beverage outlet site.

The invention claimed is:

1. Capsule for the preparation of a beverage in a beverage machine comprising:

an enclosure containing one or more beverage ingredients;

a filtering wall defining at least one filtering side of an interior of the enclosure, an overflow wall that is located in a path of a brewed liquid after a filtering wall and at least one component selected from the group consisting of means for puncturing an aperture in the overflow wall or for indicating a puncture location in the overflow wall.

2. Capsule according to claim 1, wherein
the filtering wall extends from below a median horizontal plane passing through the enclosure when the capsule is oriented so that at least one overflow aperture is located.

3. Capsule according to claim 1, wherein
the filtering wall extends substantially from a bottom of the enclosure to a top of the enclosure.

4. Capsule according to claim 1, wherein
the overflow wall is placed separately from a front of the filtering wall with an interstitial space there between.

5. Capsule according to claim 1, wherein
the overflow wall and the filtering wall are substantially parallel to each other.

6. Capsule according to claim 1, wherein
the overflow wall is a puncturable membrane.

7. Capsule according to claim 6, comprising
a shell and the puncturable membrane closes the shell in a gas tight manner.

8. Capsule according to claim 7, comprising
a cover that is attached to the shell and faces the puncturable membrane.

9. Capsule according to claim 8, wherein
the means for puncturing is located on the cover.

10. Capsule according to claim 8, wherein the cover comprises a means for guiding the beverage flow to a beverage outlet of the capsule.

11. Capsule according to claim 10, wherein
the beverage outlet is located in a region of the cover that is substantially opposite to the puncture means or puncture indicating means.

12. Capsule according to claim 10, comprising at least two means for puncturing placed at substantially opposite regions of the cover relative to a centreline of the cover.

13. Capsule according to claim 1, wherein
the capsule has an elongated shape with an axial distance and a shorter transversal distance and the means for puncturing is aligned along the axial distance.

14. Capsule according to claim 1, wherein
the at least one ingredient is tea.

15. Capsule according to claim 1, wherein
the enclosure is substantially oxygen free and impermeable to light.

16. Capsule according to claim 1 comprising at least one premade overflow aperture.

17. Capsule according to claim 16, wherein the overflow aperture is located at a position at least above three quarters of the height of the enclosure.

18. Capsule according to claim 16, wherein the overflow wall is separate from the filtering wall with an interstitial space there between.

19. Capsule according to claim 16, wherein the overflow wall and the filtering wall are adjacent while forming an interstitial space.

20. Capsule according to claim 16, wherein the overflow wall and the filtering wall are made of an integral piece.

21. Capsule according to claim 16, wherein the overflow wall is internal to the capsule and protected by an outer closing membrane.

22. Capsule according to claim 16 comprising an airtight closed cover with a sealed outlet that is unsealed just before brewing or by the use of an airtight overwrap package that encloses the capsule.

23. A capsule for the preparation of a beverage comprising:
an enclosure containing a beverage ingredient;
a filtering wall defining at least one filtering side of an interior of the enclosure; and
an overflow wall that is located in a path of a brewed liquid after a filtering wall and which comprises at least one overflow aperture.

24. Capsule according to claim 23 comprising at least one premade overflow aperture.

25. Capsule according to claim 24, wherein the overflow aperture is located at a position at least above three quarters of the height of the enclosure.

26. Capsule according to claim 24, wherein the overflow wall is separate from the filtering wall with an interstitial space there between.

27. Capsule according to claim 24, wherein the overflow wall and the filtering wall are adjacent while forming an interstitial space.

28. Capsule according to claim 24, wherein the overflow wall and the filtering wall are made of an integral piece.

29. Capsule according to claim 24, wherein the overflow wall is internal to the capsule and protected by an outer closing membrane.

30. Capsule according to claim 24 comprising an airtight closed cover with a sealed outlet that is unsealed just before brewing or by the use of an airtight overwrap package that encloses the capsule.

* * * * *